US007476854B2

(12) United States Patent
Syage et al.

(10) Patent No.: US 7,476,854 B2
(45) Date of Patent: Jan. 13, 2009

(54) HIGH SPEED, MULTIPLE MASS SPECTROMETRY FOR ION SEQUENCING

(75) Inventors: Jack A. Syage, Huntington Beach, CA (US); Karl A. Hanold, Huntington Beach, CA (US)

(73) Assignee: Syagen Technology, Tustin, CA (US)

( * ) Notice: Subject to any disclaimer, the term of this patent is extended or adjusted under 35 U.S.C. 154(b) by 41 days.

(21) Appl. No.: 11/051,427

(22) Filed: Feb. 3, 2005

(65) Prior Publication Data

US 2005/0242278 A1 Nov. 3, 2005

Related U.S. Application Data

(60) Provisional application No. 60/562,734, filed on Apr. 16, 2004.

(51) Int. Cl.
*H01J 49/10* (2006.01)

(52) U.S. Cl. ..... 250/293; 250/290; 250/291; 250/296; 250/297

(58) Field of Classification Search ..... 250/291, 250/292, 290, 293, 296, 297
See application file for complete search history.

(56) References Cited

U.S. PATENT DOCUMENTS 4,882,484 A * 11/1989 Franzen et al. ..... 250/282
5,714,755 A * 2/1998 Wells et al. ..... 250/281

* cited by examiner

*Primary Examiner*—David A. Vanore
(74) *Attorney, Agent, or Firm*—Ben J. Yorks; Irell & Manella LLP

(57) ABSTRACT

A detector system for detecting trace molecules. The detector includes an ion trap that is coupled to an ionizer and a detector. The system also includes a controller that can generate voltage potentials within the ion trap. The controller can generate a voltage waveform to isolate one or more ions within the ion trap. The controller can then generate a voltage to dissociate the isolated ion(s). The controller can vary the dissociating voltage to dissociate and detect different ions. For example, the controller may vary the amplitude of the voltage to dissociate a target ion. Other techniques are described which generally improve the speed of detecting different target ions.

26 Claims, 10 Drawing Sheets

HIGH SPEED, MULTIPLE MASS SPECTROMETRY FOR ION SEQUENCING

CROSS REFERENCE TO RELATED APPLICATIONS

This application claims priority to provisional Application No. 60/562,734, filed on Apr. 16, 2004.

BACKGROUND OF THE INVENTION

1. Field of the Invention

The subject matter disclosed generally relates to a detector that can detect trace molecules.

2. Background Information

There have been developed high-speed methods of sequencing molecular structure using a mass spectrometer and methods of applying excitation waveforms to specific ion masses. These methods belong to a class of sequential mass spectrometry analysis often referred to as MS/MS and $MS^n$. There have also been developed mass spectrometers that utilize an ion trap. The ion trap was originally invented by Paul and Stenwedel and was disclosed in U.S. Pat. No. 2,939,952. The ability to store ions and then scan them out in sequence of mass was developed by Stafford et al. and was disclosed in U.S. Pat. No. 4,540,884. Lubman published the first QitTof MS method. It used the ion trap to collect the ions in the usual manner, but analyzed the masses by pulsing the ions into a time-of-flight mass spectrometer. Syage et al. disclosed in U.S. Pat. No. 6,326,615 a QitTof MS apparatus that uses a discharge ionizer and a photoionizer.

Another useful characteristic of ion traps is the ability to apply an oscillating potential or waveform to match the frequency of a specific ion mass. The waveform excites the ions to higher kinetic energy. If driven strongly, ions of a specific mass can be made to exit the trap either to detect it or to remove it from further analysis. If driven less strongly, these ions can undergo energetic collisions in the ion trap with background gas causing them to dissociate. This process is very useful for determining the structure of the ion. Armitage et al in 1979 disclosed a method of resonant ejection of ions. Syka et al. disclosed in U.S. Pat. No. 4,736,101 a method in which the trapping field is scanned to eject unwanted ions and then changed again so that the expected daughter ions from dissociation of the remaining parent ions are stable. More sophisticated methods have been developed. Marshall et al. disclosed in U.S. Pat. No. 4,761,545 a method call tailored waveform excitation which was based on determining the frequency spectrum needed to effect excitation and then generating an inverse Fourier transform to convert the frequency spectrum into a complex waveform in the time domain. Kelley disclosed in U.S. Pat. No. 5,206,507 a method of generating a broadband noise spectrum with a notch or notches to trap one or more desired masses, while ejecting the remaining masses.

Louris has described a sum of sine method for the resonant ejection of ions in a quadrupole ion trap or an ion cyclotron resonance mass spectrometer in U.S. Pat. No. 5,324,939. The method disclosed by Louris, however does not describe a method by which such sum of sine waveforms are used to implement MS/MS nor $MS^n$ for the purpose of structure elucidation. Lubman published a demonstration of MS/MS in a QitTof MS.

A principal benefit of QitTof MS compared to ITMS is the ability to record MS spectra at high speeds. Both the QitTof MS and ITMS methods are based on an accumulation of ions in an ion trap followed by ion mass analysis of the stored ions.

In ITMS the stored ions are scanned out by the general method of mass-selective instability scan. There are several specific methods for scanning the ions; however, they are all based on the general principle of destabilizing ions of increasing mass so that they escape the ion trap and are detected by an external ion detector. If we assume a scan rate of 10,000 amu/s and a total scan range of 1000 amu, then the total scan time is 100 ms. Because injection of ions into the ion trap is avoided during this scan period, the repeat time for ion collection and scan out must be greater than 100 ms in order to have an adequate duty cycle for collection of ions. For a 50% duty cycle for collection and scan out, the maximum repetition rate of the ITMS would be 5 Hz.

The QitTof MS uses an external TOFMS for ion mass analysis. Ions that have accumulated in the ion trap are pulsed out into the TOFMS in about 10 microseconds. During the pulse out time the radiofrequency that is applied to the ion trap to store the ions is switched off. This time and the additional time for the RF to recover to a stable voltage represents the time when ion injection into the ion trap is halted. This is generally about 100-500 microseconds, which is considerably shorter than the 100 ms for the ITMS instrument. Consequently, QitTof MS can operate at much higher repetition rates and still maintain high duty cycles for ion collection.

High speed analysis is important for several reasons. First, advances in drug discovery, genomics and proteomics are creating the need to conduct analyses of ever increasing numbers of samples. Second, chromatographic techniques, such as liquid chromatography (LC) and capillary electrophoresis (CE), which are frequently used to separate the constituents of these mixtures, are being developed to operate with increasing speeds. Each constituent may elute from chromatography columns in very short time, such as less than 1 second. This requires analyzers that sample the eluting peak sufficiently often to reliably reproduce the transient signal. ITMS may not meet this requirement in many cases where QitTof MS would.

BRIEF SUMMARY OF THE INVENTION

A detector system that includes a ion trap coupled to an ionizer and a detector. The system includes a controller that can generate a voltage waveform to isolate one or more ions within the ion trap and a voltage to dissociate the isolated ion. The dissociated ion is detected within the detector. Different ions can be dissociated with various disclosed techniques.

DETAILED DESCRIPTION

Disclosed is a detector system for detecting trace molecules. The detector includes an ion trap that is coupled to an ionizer and a detector. The system also includes a controller that can generate voltage potentials within the ion trap. The controller can generate a voltage waveform to isolate one or more ions within the ion trap. The controller can then generate a voltage to dissociate the isolated ion(s). The controller can vary the dissociating voltage to dissociate and detect different ions. For example, the controller may vary the amplitude of the voltage to dissociate a target ion. Other techniques are described which generally improve the speed of detecting different target ions.

Figure 1:
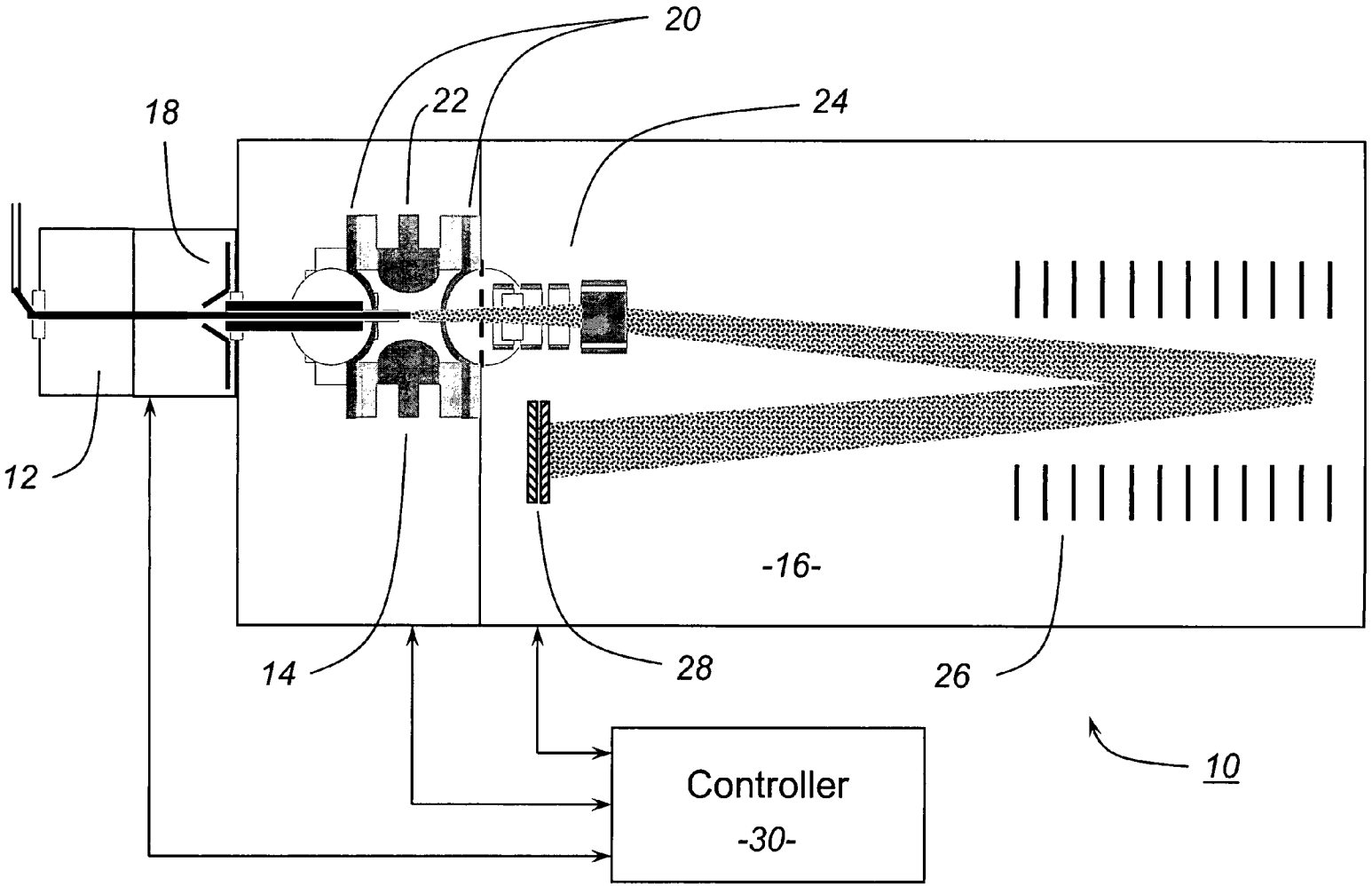
FIG. 1 is an illustration of a detector system.

Referring to the drawings more particularly by reference number, FIG. 1 shows an embodiment of a detector system 10. The detector system 10 may include an ionizer 12 that is coupled to an ion trap 14. The ion trap 14 may be coupled to a detector 16. The ionizer 12 may be of various types including electrospray, photoionizer, etc. The ions formed in the ionizer 12 may directed to the ion trap 14 by ion optics 18 as is known in the art.

The ion trap 14 may be a quadrupole trap that includes a pair of end plate electrodes 20 and a ring electrode 22. The ion trap 14 can be used to isolate and dissociate the ions directed from the ionizer 12. Once dissociated the ions are ejected from the trap 14 into the detector 16. The detector 16 may be a time of flight detector with known ion optics 24, reflectron 26 and detector 28 components.

The system may include a controller 30 that is coupled to the ionizer 12, ion trap 14 and detector 16. The controller 30 may control a sequence of ionization, isolation, dissociation, ejection and detection in the various stages 12, 14 and 16 of the system.

Figure 2:
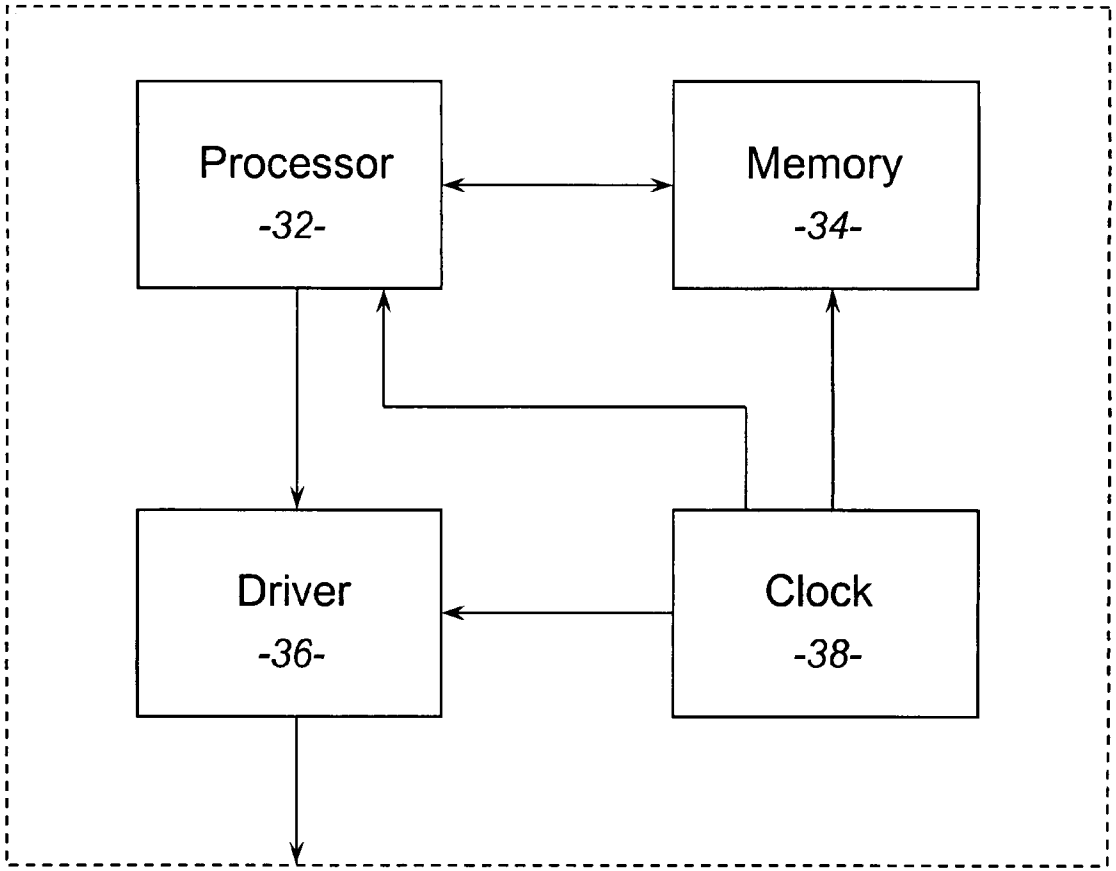
FIG. 2 is a schematic of a controller of the detector system.

FIG. 2 shows an embodiment of the controller 30. The controller 30 may include a processor 32 and memory 34. The controller 30 may also include a driver circuit 36 that can generate a voltage potential in the ion trap 14. The driver circuit 36 may receive a signal from the processor 32 that is then amplified to create the desired potential within the trap. The processor 32 may provide an analog signal to the driver or a digital bit string that is converted to an analog signal by a digital to analog converter (not shown).

The memory 34 may contain data that defines the amplitude, frequency and/or waveform shape of the voltage potential applied within the trap. By way of example, the memory 34 may have a stored waveform that is loaded into a register(s) of the processor 32. The waveform can be read out of the register and provided to the driver circuit in accordance with clock signals provided by a clock 38. The controller 30 may include a variable divide down circuit (not shown) that can vary the speed of the clock signals provided to the registers and vary the frequency of the voltage waveform applied to the trap. The divide down circuit may be controlled by the processor 32.

The following describes new methods of waveform excitations that in combination with the QitTof MS achieve high speed structure analysis of ions. These methods are also applicable to standard ITMS and related versions.

i. Fast $MS^n$ using a QitTof MS

Figure 3B:
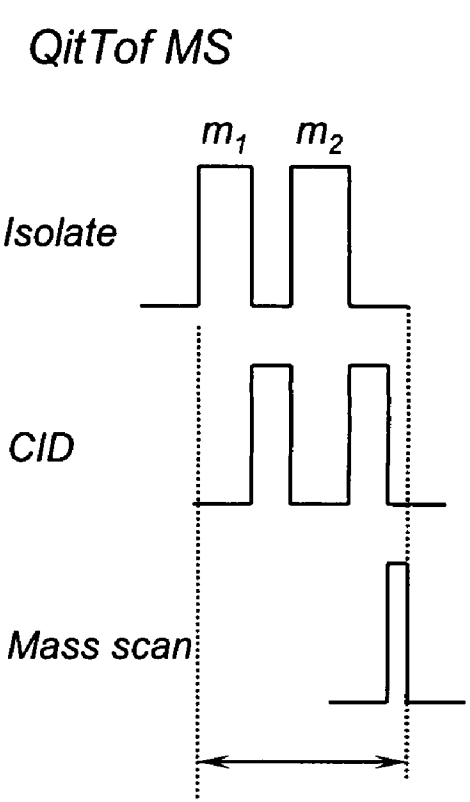
FIG. 3B is a timing diagram for isolating excitation and mass analysis for a QitToF detector.
Figure 3A:
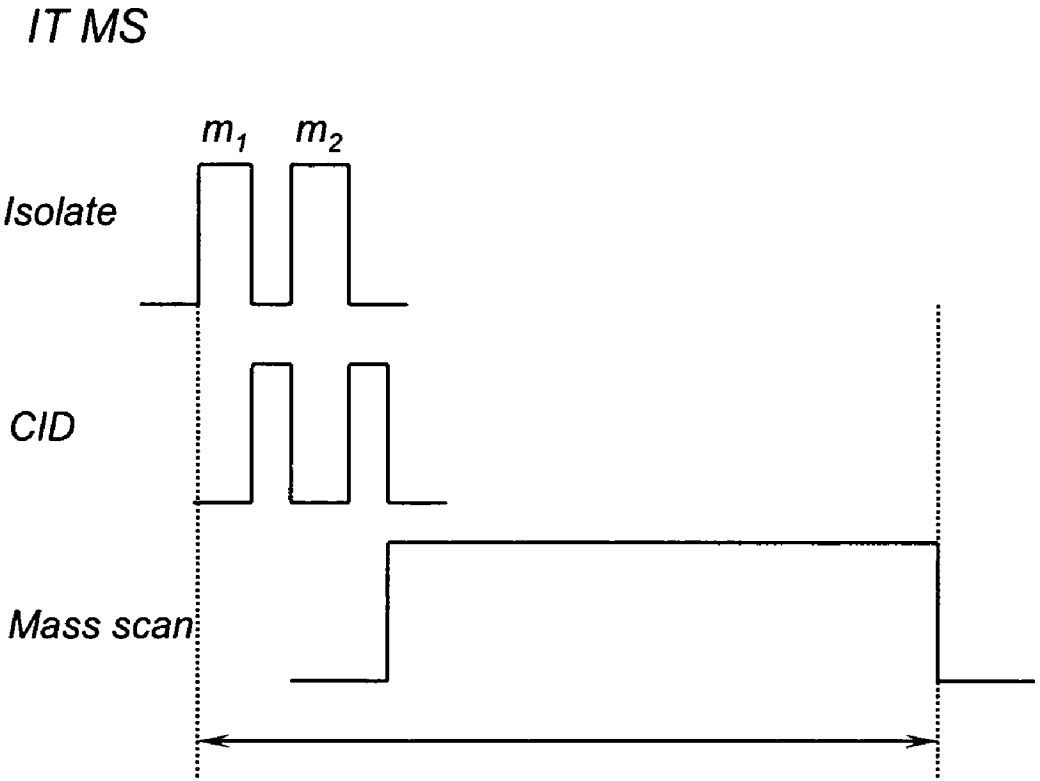
FIG. 3A (Prior Art)
FIG. 3A is a timing diagram for isolation, excitation and mass analysis for a prior art ITMS detector.

The standard $MS^n$ routine involves a sequence of ion mass isolation and collision-induced dissociation (CID) excitation steps. The general method is to use a notch filter to excite and eject all but one ion mass followed by the complementary waveform that then excites the selected mass to effect CID. Other methods of isolation may be used, such as applying a DC voltage to the ion trap to shift the stability diagram in such a manner as to limit the range of ions that are stable in the ion trap to as narrow as a single ion mass. The principle of isolation and excitation stages is illustrated in FIG. 3. The timing diagram gives an example of a $MS^3$ sequence and shows that the entire waveform excitation and ion mass analysis is completed in less time for the QitTof MS vs. ITMS. Ion collection occurs during the $m_1$ isolate stage. Ions are prevented from entering the trap after this period.

Figure 4B:
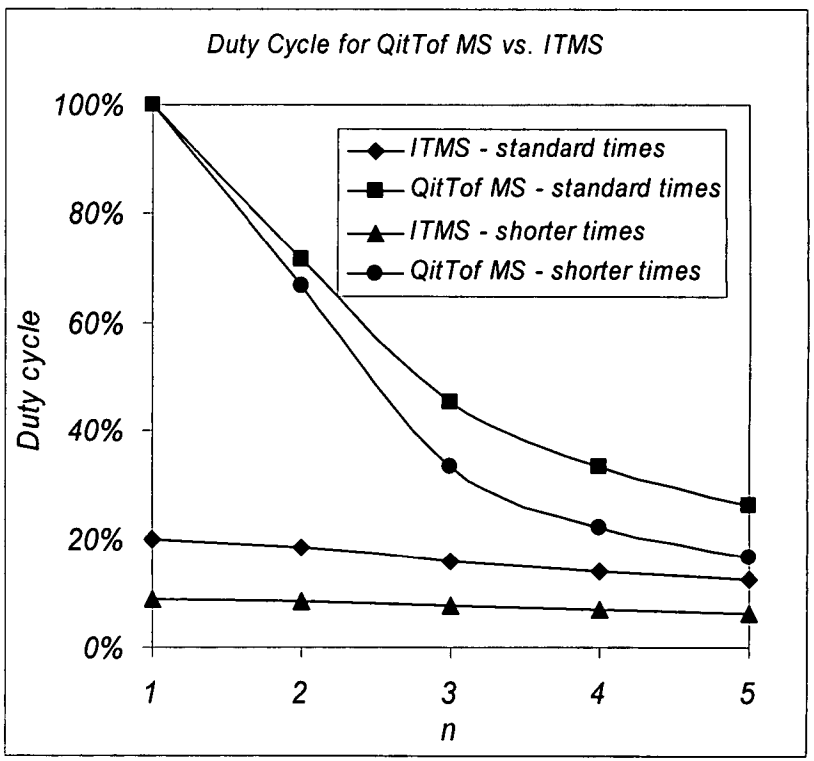
FIGS. 4A-B are graphs comparing repetition rate and duty cycle for $MS^n$ for QitTof MS vs. ITMS, respectively.
Figure 4A:
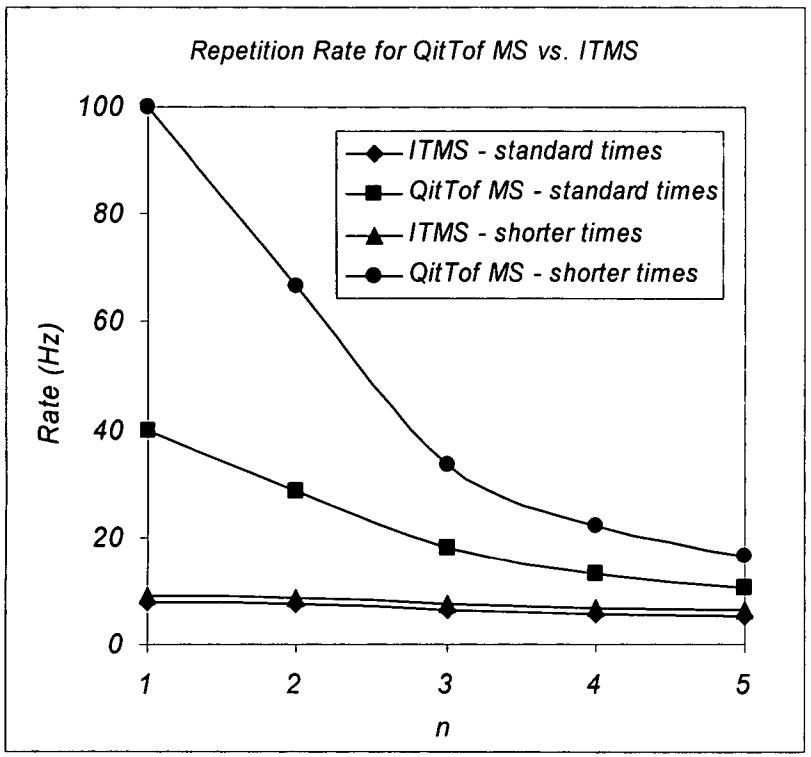

Table I compares the rates for $MS^n$ analysis by ITMS [Table I(a)] and QitTof MS [Table I(b)]. In the latter case, the isolation and excitation periods are shortened in order to increase the repetition rate of the QitTof MS. Not shown in Table I, but plotted in FIGS. 4A-B, are the cases for QitTof MS with the standard isolation/excitation time periods and ITMS with the shortened period. The point of this comparison is to show that the shortened time periods are more beneficial to QitTof MS than to ITMS with regard to repetition rate and duty cycle. That is because the mass analysis time dominates the ITMS repetition rate cycle and any efficiencies applied to the isolate/excitation period are less meaningful.

Figures 5A, 5B:
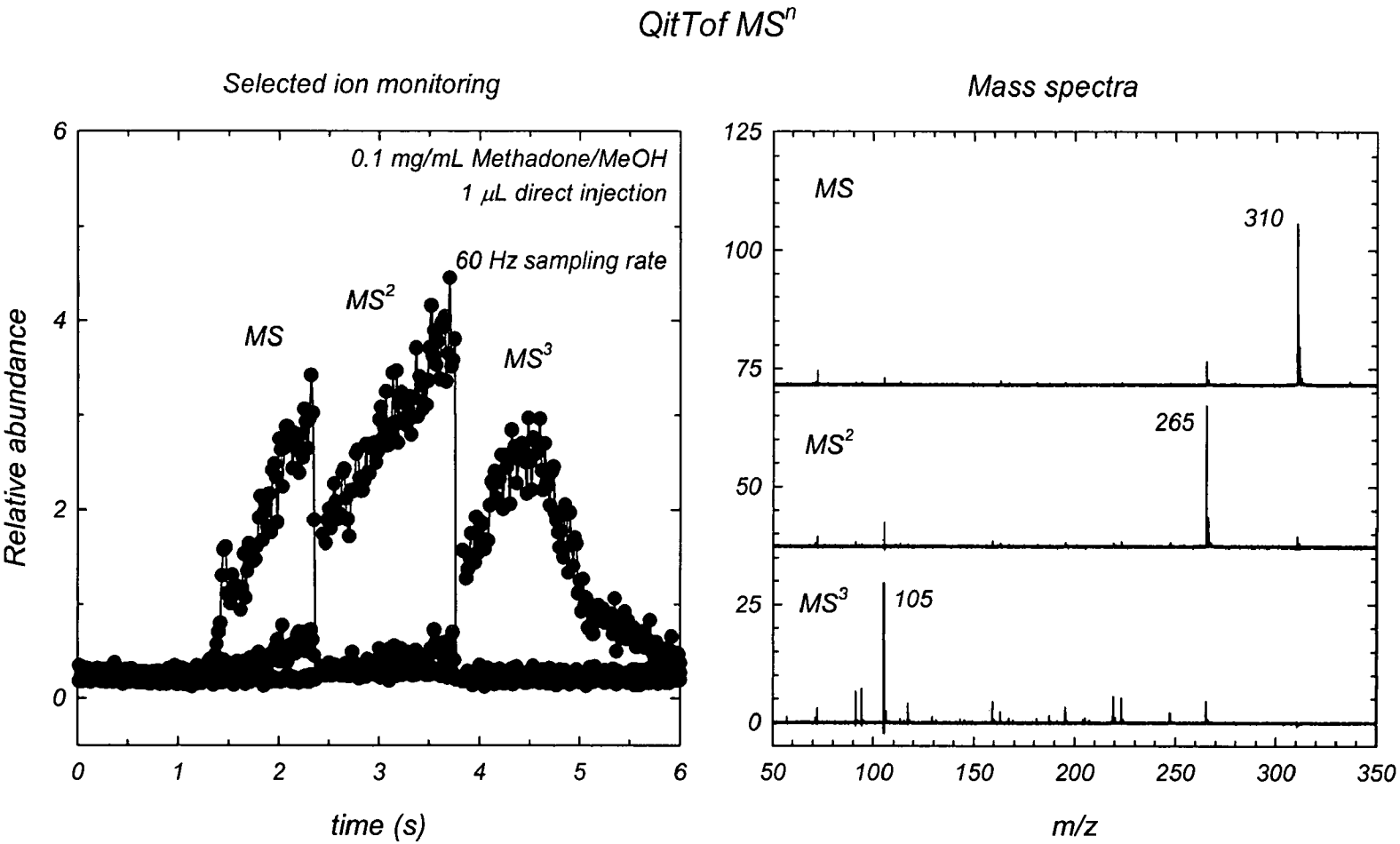
FIGS. 5A-5B are graphs of MS, $MS^2$, and $MS^3$ spectra of a transient sample.
Figure 6:
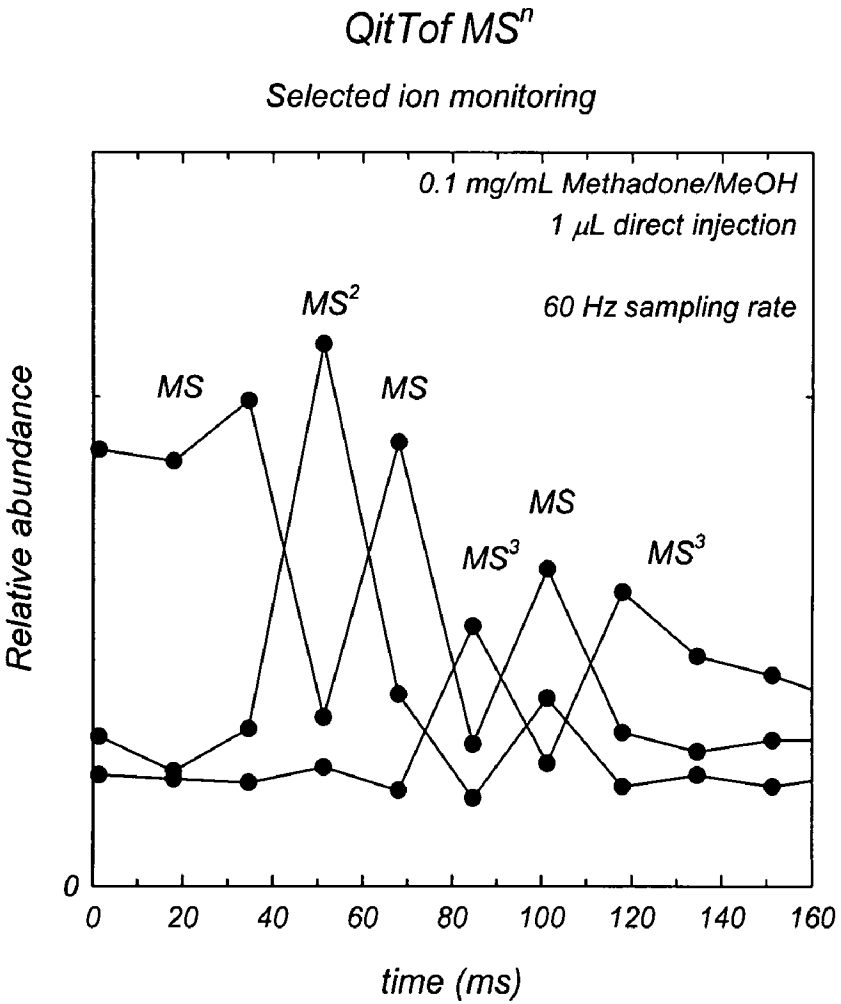
FIG. 6 is a graph showing the potential to change the $MS^n$ level for sequential pulses.

Fast $MS^n$ has been demonstrated on the QitTof MS. FIGS. 5A-B show sequential MS, $MS^2$, and $MS^3$ analysis using intensity thresholds to trigger successive waveform excitations. In this example, a methadone sample is syringe injected; the 4 s elapsed time mimics fast LC and CE peaks. Isolation waveforms were not used in this example. The CID waveforms for the $MS^3$ case were played sequentially. FIG. 6 demonstrates a change in the waveform on successive pulses in order to test the upper speed limit for fast $MS^n$ analysis. These results indicate that QitTof $MS^n$ achieves selected ion fragmentation for structure analysis and sequencing at much higher rates of speed than prior art methods.

TABLE I

ITMS vs. QitTof MS using conventional $MS^n$ routines

| | Number of Waveforms | | | | Time (ms) | | | | Time (ms) | Rep. rate (Hz) | Duty cycle |
|---|---|---|---|---|---|---|---|---|---|---|---|
| $MS^n$ | Isolate 1 | Isolate2 | CID | scan out | Isolate 1 | Isolate2 | CID | mass scan | Total | maximum | % collect |
| (a) ITMS using standard isolate and CID times | | | | | | | | | | | |
| 1 | 1 | | | 1 | 25 | | | 100 | 125.00 | 8.0 | 20% |
| 2 | 1 | | 1 | 1 | 25 | | 10 | 100 | 135.00 | 7.4 | 19% |
| 3 | 1 | 1 | 2 | 1 | 25 | 10 | 10 | 100 | 155.00 | 6.5 | 16% |
| 4 | 1 | 2 | 3 | 1 | 25 | 10 | 10 | 100 | 175.00 | 5.7 | 14% |
| 5 | 1 | 3 | 4 | 1 | 25 | 10 | 10 | 100 | 195.00 | 5.1 | 13% |

TABLE I-continued

| ITMS vs. QitTof MS using conventional $MS^n$ routines | | | | | | | | | | | |
|---|---|---|---|---|---|---|---|---|---|---|---|
| | Number of Waveforms | | | | Time (ms) | | | | Time (ms) | Rep. rate (Hz) | Duty cycle |
| $MS^n$ | Isolate 1 | Isolate2 | CID | scan out | Isolate 1 | Isolate2 | CID | mass scan | Total | maximum | % collect |
| (b) QitTof MS using shorter isolation and CID times | | | | | | | | | | | |
| 1 | 1 | | | | 10 | | | 0 | 10.00 | 100.0 | 100% |
| 2 | 1 | | 1 | | 10 | | 5 | 0 | 15.00 | 66.7 | 67% |
| 3 | 1 | 1 | 2 | | 10 | 10 | 5 | 0 | 30.00 | 33.3 | 33% |
| 4 | 1 | 2 | 3 | | 10 | 10 | 5 | 0 | 45.00 | 22.2 | 22% |
| 5 | 1 | 3 | 4 | | 10 | 10 | 5 | 0 | 60.00 | 16.7 | 17% |

The speed advantage of QitTof MS compared to ITMS becomes less pronounced for higher levels of $MS^n$ when using the conventional $MS^n$ routines because the total spectral acquisition time becomes dominated more by the string of isolation and CID waveforms than by the ion mass analysis method. More streamlined $MS^n$ routines greatly benefit the analysis speed for QitTof because of the short TOF mass analysis time. Faster $MS^n$ routines do not necessarily improve analysis speed by ITMS because of the limiting time to conduct the mass-selective instability scan. For example, reducing the Isolate 1 and CID times to achieve shorter overall analysis times while still maintaining duty cycles for ion collection that exceed ITMS as shown in Table Ic. Another strategy is to reduce the number of isolation steps. For highly separated chromatograms, the first isolation step may be unnecessary. It is also possible to use an initial isolation step to store a single ion mass, and then initiate a series of CID waveforms without further isolation. Table II shows the speed improvement resulting from this routine.

TABLE II

| Improved QitTof $MS^n$ analysis speed by dispensing with subsequent isolation steps. | | | | | | | | | | | |
|---|---|---|---|---|---|---|---|---|---|---|---|
| | Number of Waveforms | | | | Time (ms) | | | | Time (ms) | Rep. rate (Hz) | Duty cycle |
| MS &thŝp;n | Isolate 1 | Isolate2 | CID | scan out | Isolate 1 | Isolate2 | CID | mass scan | Total | maximum | % collect |
| 1 | 1 | | | | 10 | | | 0 | 10.00 | 100.0 | 100% |
| 2 | 1 | | 1 | | 10 | | 5 | 0 | 15.00 | 66.7 | 67% |
| 3 | 1 | | 2 | | 10 | | 5 | 0 | 20.00 | 50.0 | 50% |
| 4 | 1 | | 3 | | 10 | | 5 | 0 | 25.00 | 40.0 | 40% |
| 5 | 1 | | 4 | | 10 | | 5 | 0 | 30.00 | 33.3 | 33% |

ii. RF Amplitude Switching

Figure 7:
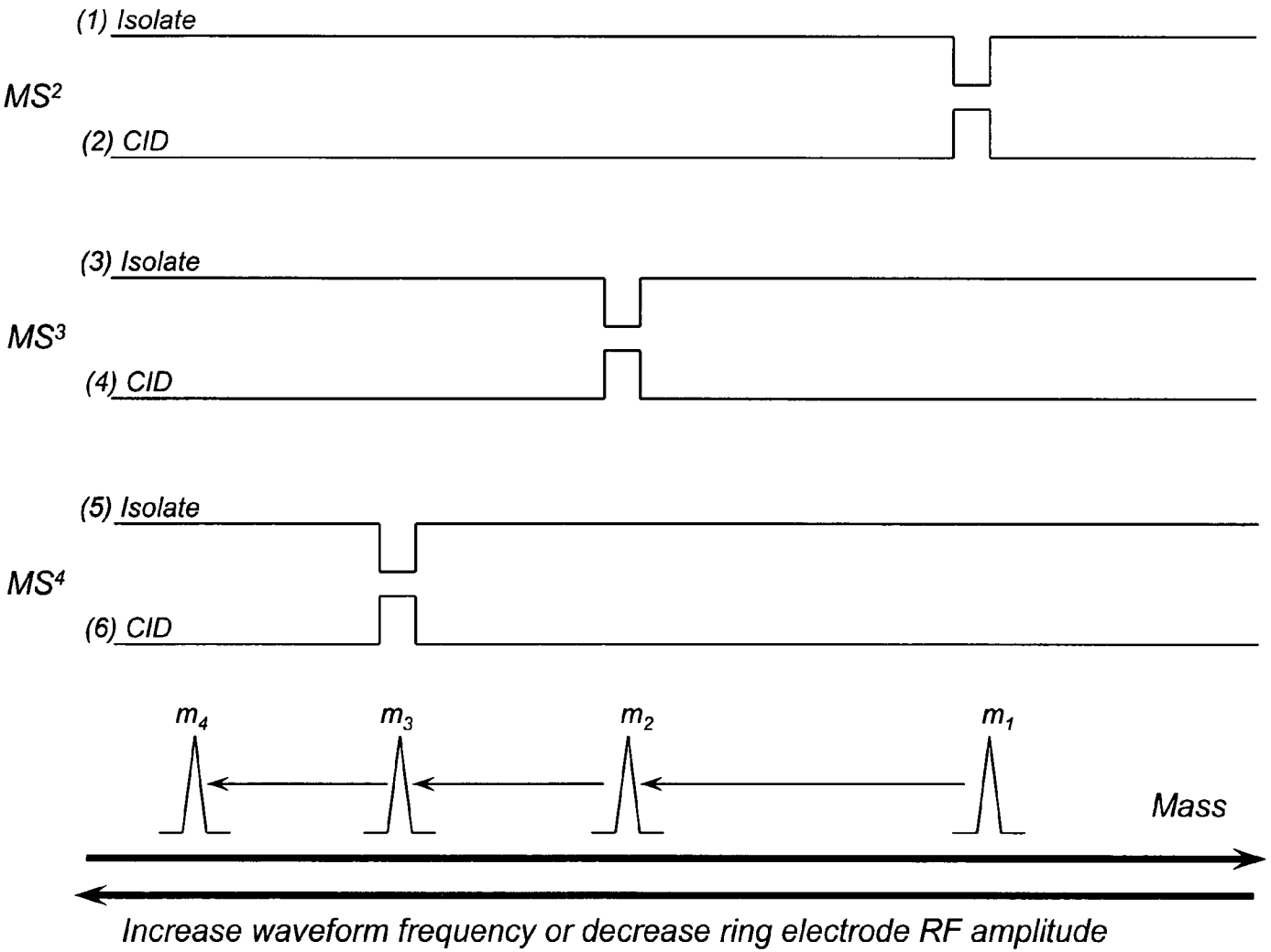
FIGS. 7 is a timing diagrams showing a method to achieve isolation and excitation with a pair of stored waveforms and adjusting the affected m/z by varying the RF amplitude.

The isolation (notch) and CID (single-frequency) waveforms need to be tuned to the specific mass being isolated and excited. This may be achieved by either varying the waveform frequency or by varying the RF amplitude, which changes the secular frequency of a given mass to match a given waveform frequency. FIG. 7 illustrates the sequence of isolate and CID waveforms that must be played for an $MS^4$ analysis. The bottom axis of the figure shows how the waveform frequency or the RF amplitude have to be changed to bring the new daughter fragment ion into resonance.

The motion of an ion in a quadrupolar field can be described by solutions to the Mathieu equation. A characteristic equation that describes regions of stability in an ion trap is $$q_z = \frac{8eV}{m(r_0^2 + 2z_0^2)\Omega^2} \tag{1}$$

where V is the RF amplitude and Ω the RF frequency applied to the ion trap ring electrode, m is the ion mass (m/z), $r_0$ is the radius of the ring electrode and $z_0$ is the inscribed radius of the end cap electrodes. The secular frequency $\omega_z$ along the ion trap z-axis is given by $$\omega_z = \frac{\beta_z}{2}\Omega \tag{2}$$

where $\beta_z$ is a complicated function that describes regions of ion stability and can be computed from a solution of continued fractions. For the standard case where no DC voltage is applied to the ion trap and making other assumptions leads to the approximate relation $\beta_z = q_z/2^{1/2}$. For this discussion it is sufficient to recognize that $\beta_z$ is roughly proportional to V. It can therefore be seen that the secular frequency for a particular ion mass can be varied by varying either V or Ω. Conversely it is possible to fix the excitation waveform frequency (isolation and CID) and bring different masses into resonance by varying V. In order to achieve the high $MS^n$ speeds in Tables I and II the isolation and CID waveforms are only about 10 and 5 ms. Hence, the RF amplitude V needs to be switched in a much shorter period of time, namely about a 1 ms.

iii. Vary Clock Speed

Varying RF amplitude V to bring different ion masses into resonance with a fixed set of isolation and CID waveforms was described above. Another method is to vary the waveform frequencies. The challenge is that the recalculation and download times must also be short. Again this should be on the order of 1 ms. Another way to achieve fast frequency shifting is to vary the clock speed that is used to play back the waveform. Disclosed is a method in which clock speeds can be divided digitally by integer numbers, n. In order to have sufficiently fine resolution on frequency changes, one must divide by relatively large integer values. We make use of the approximate relationships $\omega \propto 1/m^2$ and $\omega \propto 1/n$ to obtain $$\frac{m}{\Delta m} = \frac{-\omega}{2\Delta\omega} = \frac{-n}{2\Delta n} \tag{3}$$

Low values of n correspond to high ω and low m. Hence the poorest isolation and CID resolution will be at low mass. For a typical ring electrode RF frequency of Ω=1 MHz, the highest secular frequency ω, which corresponds to the lowest mass m, will be 500 kHz. If we use a 40 MHz clock and require at least 4 points to digitally define 500 kHz, then we can use an integer value of n=20 (i.e., 2 MHz). This would correspond to a m/Δm of 40. Table III calculates the masses that correspond to the resonant frequencies achievable by dividing the waveform clock frequency. Isolation and CID mass resolutions of about 100 are sufficient for many applications. One application is high-resolution chromatography, where the separation renders the need for high mass resolution less important.

TABLE III

Secular frequencies and masses by digitally dividing the waveform clock frequency (low mass cutoff is set at m/z 200).

| n | ω | m |
|---|---|---|
| 20 | 500.0 | 200.0 |
| 21 | 476.2 | 204.9 |
| 22 | 454.5 | 209.8 |
| 23 | 434.8 | 214.5 |
| 24 | 416.7 | 219.1 |
| 25 | 400.0 | 223.6 |
| 26 | 384.6 | 228.0 |
| 27 | 370.4 | 232.4 |
| 28 | 357.1 | 236.6 |
| 29 | 344.8 | 240.8 |
| 30 | 333.3 | 244.9 |
| 90 | 111.1 | 424.3 |
| 91 | 109.9 | 426.6 |
| 92 | 108.7 | 429.0 |
| 93 | 107.5 | 431.3 |
| 94 | 106.4 | 433.6 |
| 95 | 105.3 | 435.9 |
| 96 | 104.2 | 438.2 |
| 97 | 103.1 | 440.5 |
| 98 | 102.0 | 442.7 |
| 99 | 101.0 | 445.0 |
| 100 | 100.0 | 447.2 |
| 490 | 20.4 | 989.9 |
| 491 | 20.4 | 991.0 |
| 492 | 20.3 | 992.0 |
| 493 | 20.3 | 993.0 |
| 494 | 20.2 | 994.0 |
| 495 | 20.2 | 995.0 |
| 496 | 20.2 | 996.0 |
| 497 | 20.1 | 997.0 |
| 498 | 20.1 | 998.0 |

TABLE III-continued

Secular frequencies and masses by digitally dividing the waveform clock frequency (low mass cutoff is set at m/z 200).

| n | ω | m |
|---|---|---|
| 499 | 20.0 | 999.0 |
| 500 | 20.0 | 1000.0 |

An alternative to changing the clock frequency is to drop points from the digitized waveforms. For example, a 5% change in waveform frequency can be effected by changing a waveform where every $20^{th}$ point is played to one where every $21^{st}$ point is played. For the highest frequency assumed of 500 kHz and 4 points per period, to achieve an every $20^{th}$ point waveform corresponds to a 40 MHz clock speed. This is the same as assumed above. By operating at lower clock speed or fewer numbers of points, the effective frequency is reduced. When using a notch filter, the highest frequencies will also decrease. In order to maintain an adequate high-frequency response, it may be necessary to add a supplemental band of frequencies or extend the initial high frequency limit sufficiently above the low mass cutoff to compensate for the reduced frequency process.

iv. Real-Time Waveform Calculations

A way to achieve fast data-dependent $MS^n$ routines is to combine the above waveform switching methods with a real-time multifrequency calculation for downloading and playing new waveforms. By data-dependent $MS^n$, we mean implementing a new $MS^n$ waveform based on the mass spectrum recorded from the previous $MS^n$ analysis. Conducting this real-time method at high repetition rates will test the limits of current processors, hence, efficient routines will be greatly needed.

Figures 8A, 8B, 8C:
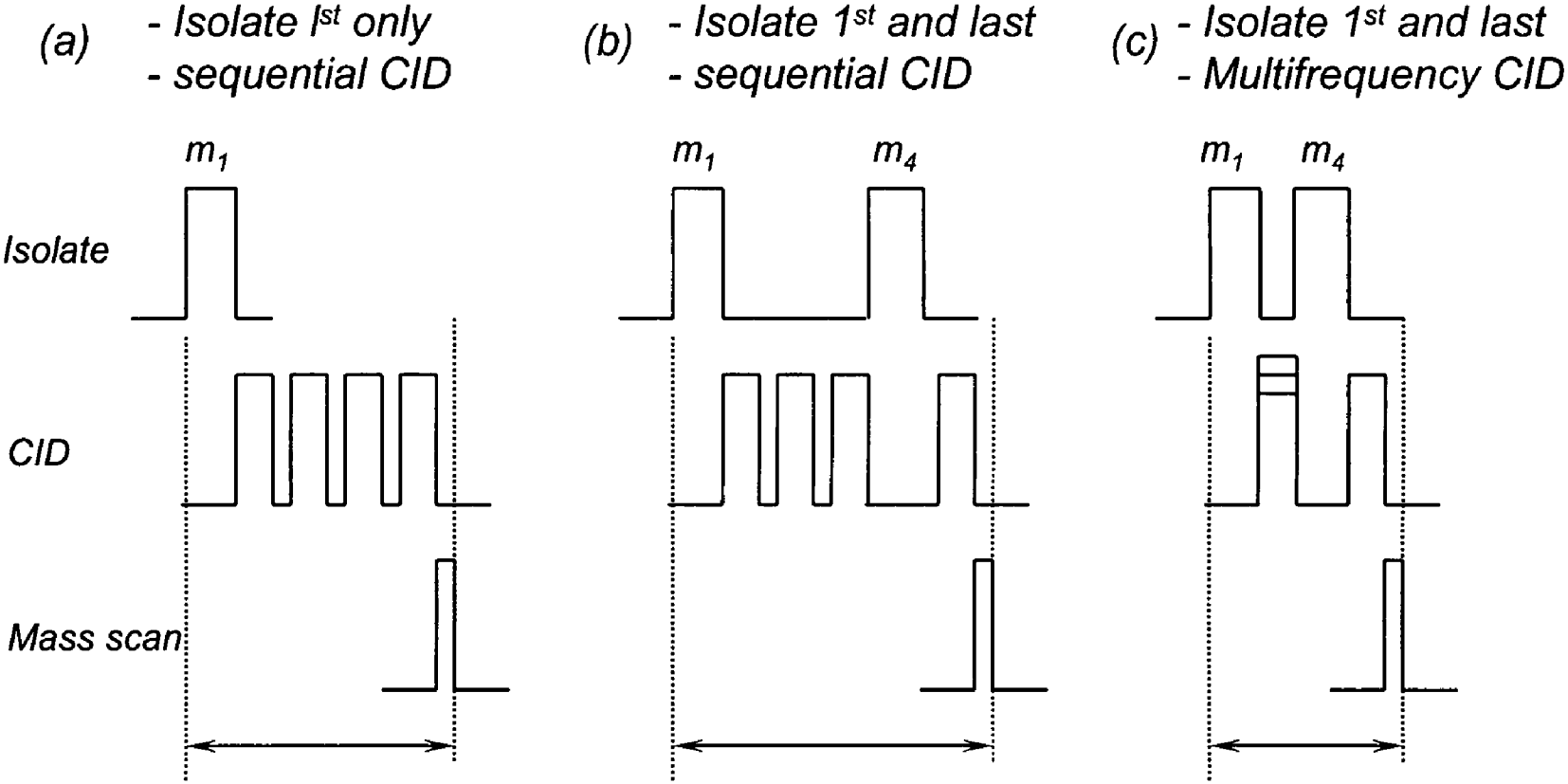
FIGS. 8A-C shows some fast sequential $MS^n$ sequential methods.

FIGS. 8A-C shows some streamlined isolation/CID sequences. FIG. 8A shows the use of an initial isolation waveform followed by sequential CID. The analysis speeds were calculated earlier in Table II. The reason for using isolation is to be able to identify the parentage of all fragments or daughters. By dispensing with intermediate isolation steps, then situations can arise where this sequence information is lost. For example if parent A gives daughters B and C and B also gives C (i.e. granddaughter of A), then it is difficult without isolating B to know if C came from A or B. The routine in FIG. 8B solves this problem. For $MS^3$, one would isolate $m_1$ (i.e., A) and $m_2$ (i.e., B). This would identify C as coming from both A and B. Once this is known, it is not necessary to isolate B when doing an $MS^4$ routine, to determine the daughters of C. In other words, once you know the sequence of n→n+1, it is no longer necessary to isolate n, but it is necessary to isolate n+1 in order to identify n+2. We therefore advocate a routine such as in FIG. 8C consisting of a series of analyses MS, $MS^2$, $MS^3$, . . . , $MS^n$. If the concept of FIG. 8B is accepted, then it should be clear that the series of CID waveforms can be combined into a single multifrequency waveform as shown in FIG. 8C. This would drive $m_1$ down to $m_4$, which is then isolated to perform the fragmentation sequence for $m_4$. Table IV calculates analysis speeds, which can be compared to the methods in Tables I and II. In Table V, we calculate the minimum analysis times to conduct a full ion sequence to the $MS^5$ level using the conventional ITMS routine vs. the various QitTof MS routines described here.

TABLE IV

QitTof sequencing with first and last isolate and single multifrequency CID waveform

| | Number of Waveforms | | | | Time (ms) | | | | Time (ms) | Rep. rate (Hz) | Duty cycle |
|---|---|---|---|---|---|---|---|---|---|---|---|
| MS &thŝp;n | Isolate 1 | Isolate2 | CID | scan out | Isolate 1 | Isolate2 | CID | mass scan | Total | maximum | % collect |
| 1 | 1 | | | | 10 | | | 0 | 10.00 | 100.0 | 100% |
| 2 | 1 | | 1 | | 10 | | 5 | 0 | 15.00 | 66.7 | 67% |
| 3 | 1 | 1 | 1 | | 10 | 10 | 5 | 0 | 25.00 | 40.0 | 40% |
| 4 | 1 | 1 | 1 | | 10 | 10 | 5 | 0 | 25.00 | 40.0 | 40% |
| 5 | 1 | 1 | 1 | | 10 | 10 | 5 | 0 | 25.00 | 40.0 | 40% |

TABLE V

Analysis time (ms) for a MS, $MS^2$, $MS^3$, $MS^4$, $MS^5$ series

| | ITMS Standard | QitTof Standard | QitTof Streamlined |
|---|---|---|---|
| MS | 125.00 | 10.00 | 10.00 |
| MS + $MS^2$ | 260.00 | 25.00 | 25.00 |
| MS + $MS^2$ + $MS^3$ | 415.00 | 55.00 | 50.00 |
| MS + $MS^2$ + $MS^3$ + $MS^4$ | 590.00 | 100.00 | 75.00 |
| MS + $MS^2$ + $MS^3$ + $MS^4$ + $MS^5$ | 785.00 | 160.00 | 100.00 |

v. Amplitude and Frequency Modulation of Waveforms

In order to fragment an ion by a CID waveform, the voltage amplitude must be set sufficiently high to accelerate the ions to high enough collision energy to fragment, but not so high as to drive them out of the ion trap as one would for ion ejection. There are two issues we address: (1) providing sufficiently fine control of the voltage amplitude in order to achieve the optimum voltage, and (2) in cases where the optimum voltage is not known, such as for unidentified ions, providing a means to oscillate or vary the voltage so that the ions pass through the optimum collision energy.

The use of RF amplitude switching to bring ions into resonance with the isolation and CID waveform frequencies greatly reduces the number of distinct waveforms that needs to be stored in the processor memory. This makes it possible to store the same waveform frequency, but at several intensities. Alternatively an RF amplifier may be used to continuously vary the waveform amplitude. However when the waveform is combined with the primary ring electrode ion trapping RF, it can be difficult to control the amplitude of the waveform frequency without affecting the ring RF. In this invention we disclose a method that stores the same waveform in different memory allocations with intensities in binary increments of $2^n$. For example, if four memory allocations are available then the waveforms may be stored with relative intensities of 1, 2, 4, 8. By summing all possible combinations, it is possible to achieve relative intensities ranging from 0 to 15 in increments of 1.

Figure 9:
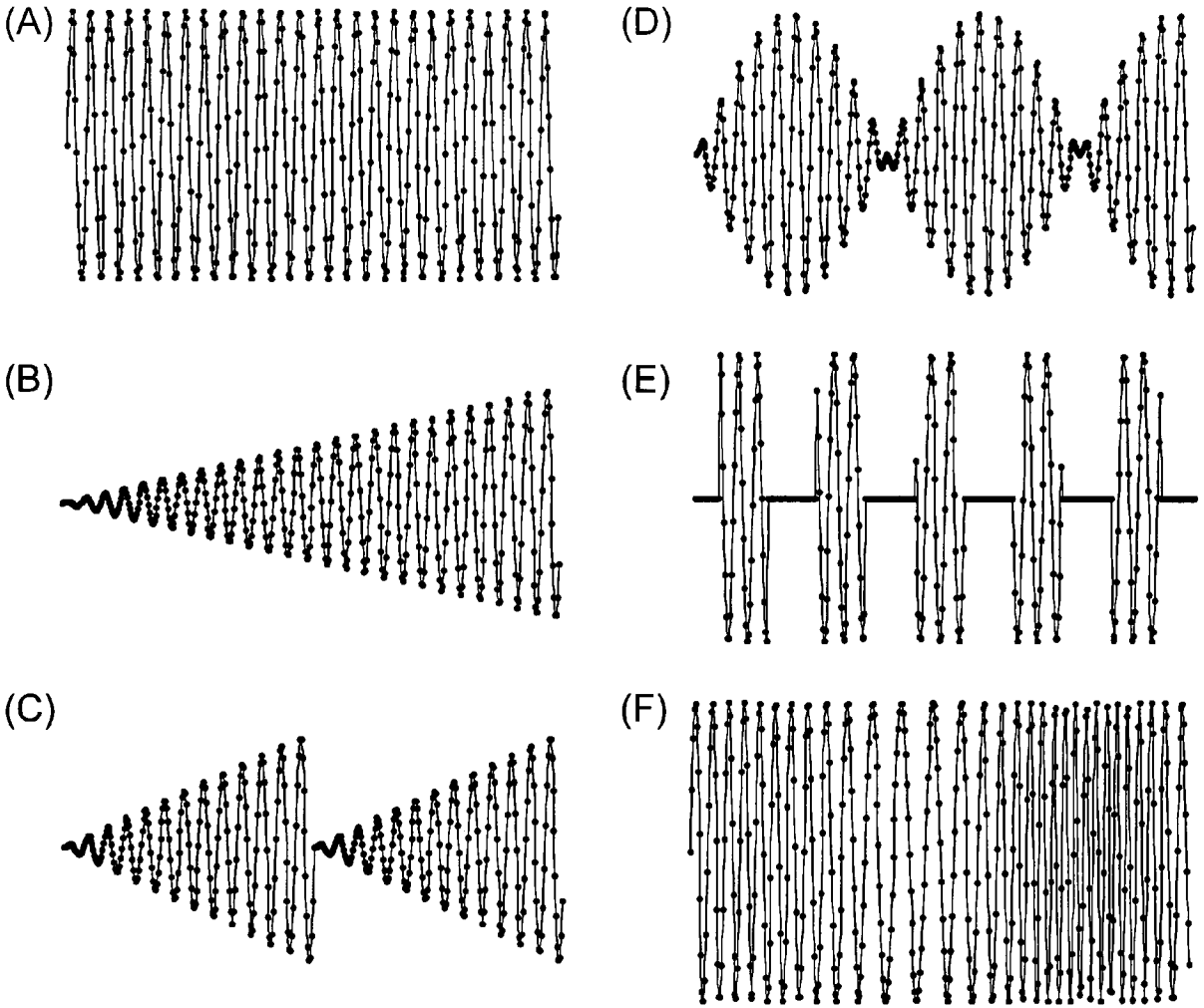
FIG. 9A-F are illustrations showing examples of different methods of amplitude modulation of excitation waveforms.

Another method disclosed here is to store the waveforms with a superimposed amplitude modulation. FIG. 9 gives examples of these amplitude modulations. The standard waveform is of constant amplitude and frequency (FIG. 9A). Modulated waveforms can have many forms. Examples include a single ramp (FIG. 9B), a multiple ramp, such as a saw tooth (FIG. 9C), a sinusoidal function (FIG. 9D), or a series of step functions (FIG. 9E). These types of modulation are presented by way of example and the disclosed method is not limited to these examples. The basis for this method is to choose an upper limit on the amplitude modulation that is expected to be higher than the optimum collisional excitation energy, but not so high as to eject ions from the ion trap. By this method, the ions are efficiently cycled through the efficient collision regime and will have a high efficiency for collisionally dissociating without being lost from the ion trap.

Another method for varying the excitation energy of selected ions is to vary the excitation frequency so as to bring it into and out of resonance with the ion (FIG. 9F). This would have a similar effect as the amplitude modulations above. The advantage to frequency modulation is that it may be preferable in cases where the exact excitation frequency is not known or may change due to changes in instrument conditions.

Another method disclosed here is based on an anharmonic ion trap created by many known methods, such as distorting the ideal ion trap dimensions. In an anharmonic ion trap, the secular frequency of an ion changes with its position in the ion trap. If a waveform of fixed frequency is used to excite and energize an ion from a low kinetic energy of low amplitude of motion, it will no longer be resonant when driven to a high kinetic energy with a high amplitude of motion. This may be useful when attempting CID because it inhibits driving the ions out of the ion trap, however, it may not be ideal when trying to eject ions from the ion trap. We disclose a method that uses a fixed frequency CID waveform to excite ions in an anharmonic ion trap and a frequency swept or chirped waveform for ejecting ions. In the latter case the frequency sweep is optimized to match the changing frequency of an ion as it is being excited to higher amplitudes of motion.

vi. Quadrupolar Waveform Excitation

Conventional ITMS generally provides excitation to ions by applying waveforms to the endcaps of the QIT. The potential gradient runs parallel to the z-direction and is therefore referred to as dipolar excitation. For QitTof MS, ions are extracted into the TOF mass analyzer by applying high voltage pulses to the endcaps. Waveform excitation can still be applied to the endcaps if fast switching isolation electronics are incorporated to protect the waveform electronics from the high voltage pulses. An alternative method to provide waveform excitation to a QitTof MS is to apply the waveforms onto the ring electrode. This requires a band pass circuit to superimpose the lower frequency low amplitude waveform (typically 10-500 kHz, 0-10 V) onto the higher frequency, high amplitude ion trapping waveform (typically 1 MHz, 0-5000 V). Because the potential gradient has components along both the z- and the redirection, this method is referred to as quadrupolar excitation. Whereas dipolar excitation affects only the axial mode of ions, quadrupolar excitation affects both the axial and radial modes of the ions. Because these two modes have different frequencies, the optimum waveforms for quadrupolar excitation differ from dipolar excitation.

For low values of $q_z$ the relationship for axial and radial frequencies is $\omega_r \approx \omega_z/2$. Referring to FIG. 7, for quadrupolar excitation it may be advantageous to provide frequencies at both the axial and radial frequencies. For ion isolation, a notch may be placed at both the axial and radial frequencies. If a notch is placed at only one frequency than the ion may be excited at the other frequency and not be stabilized in the QIT. For CID excitation, only one frequency is needed to excite the ions to dissociate, although it may be advantageous to provide both frequencies. It is also possible that the narrowness of the resonance condition for excitation will differ for axial vs. radial excitation and the choice may be made to choose one or the other depending on the application. For example, where a sharp resonance is needed, such as for isolating one mass among several closely lying masses, the axial mode at higher frequency may give more specific excitation of the ions. If a sharp resonance is not needed, then a broader excitation may be desirable because it is less prone to instrument drifting and may give more reliable operation over longer periods of time.

vii. Multiple Compound MS/MS

Another mass spectrometer type that can perform MS/MS experiments is a triple quadrupole mass spectrometer (TQMS) There are two important modes of operation for CID:

$$M^{+} \rightarrow [M-m]^{+} + m \text{ (neutral loss)}$$

$$M^{+} \rightarrow [M-m]^{+} + m^{+} \text{ (precursor scan)}$$

The first quadrupole is tuned to transmit ion mass $M^+$ to the second quadrupole where CID takes place. For neutral loss detection the third quadrupole is tuned to ion mass $[M-m]^+$ and for precursor scan it is tuned to ion mass $m^+$. TQMS systems are very efficient when measuring just one ion mass $M^+$. If measuring several ions of different mass $M^+$, the instrument must scan to each mass and is incapable of making a simultaneous measurement of all ion masses. The QitTof MS and the ion trap MS can effectively collect all masses simultaneously. To increase the speed of an analysis of a mixture of compounds, a method is needed that can isolate all the desired ion masses at once, CID them all, and then analyze the required products $[M-m]^+$ and $m^+$. The use of multiple notch filters has been disclosed in prior art. However, the method was not extended to achieve the equivalent of simultaneous neutral loss and precursor scan.

Figure 10:
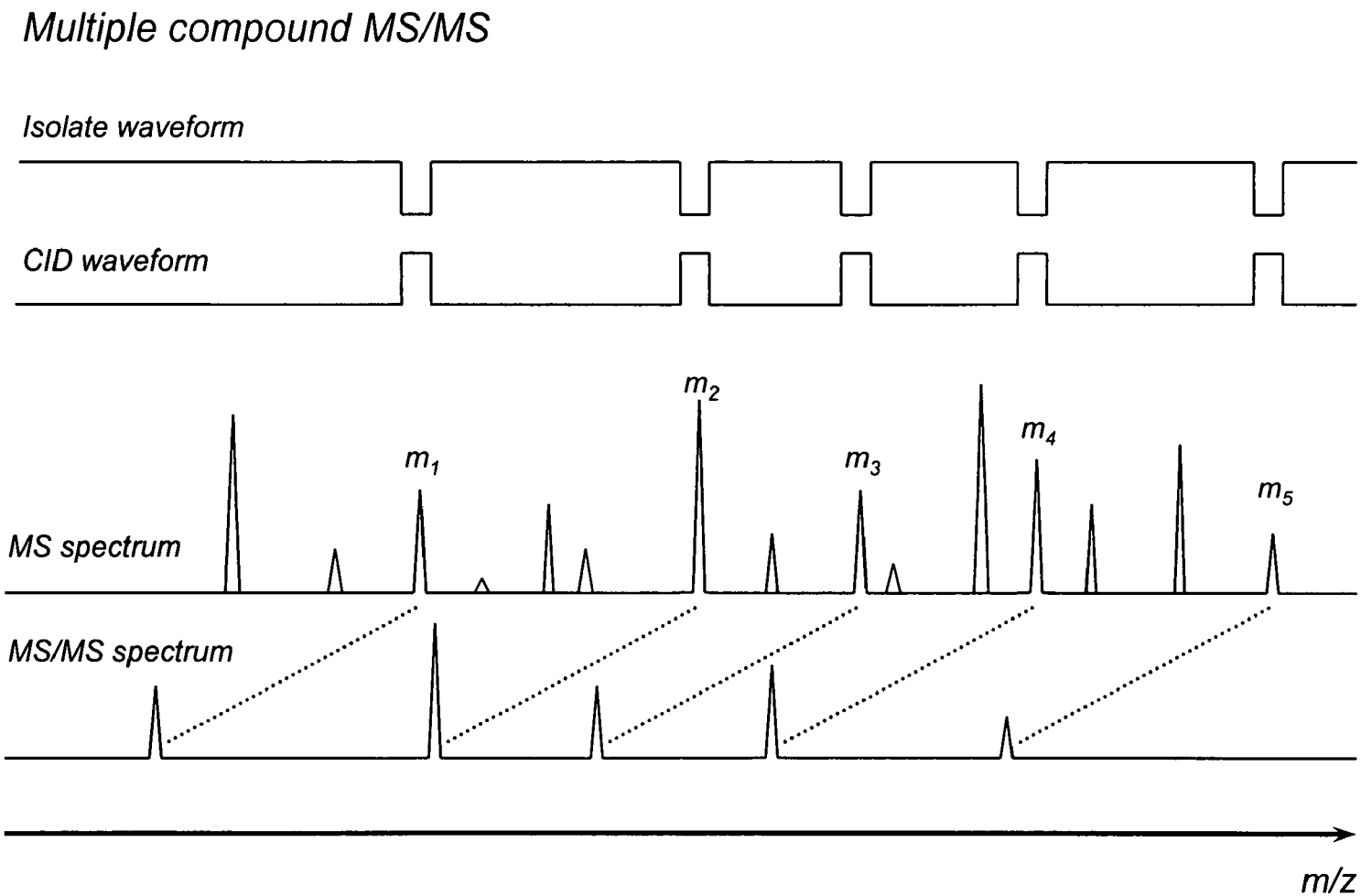
FIG. 10 is an illustration showing the isolation and dissociation of a plurality of ions.

As represented in FIG. 10, the isolation waveform contains notches at the desired parent ion masses (five are shown in this example). These selected ion masses are then excited with the conjugate waveform to excite them to undergo CID to fragment ions. By way of example amino acids and derivatives of amino acids generally dissociate a neutral m fragment given by the chemical structure. $RCO_2X$, although other fragments may occur that would be missed by TQMS. TOF analysis of the MS/MS spectrum affords the detection of all possible fragment ions, whereas the TQMS detects a single neutral loss channel (unless operated in full scan mode at much lower sensitivity). The TOF analysis collects the entire fragment spectrum simultaneously so that any number of desired fragment ions may be monitored without any sacrifice in analysis speed. The same multiple MS/MS method may be performed by ITMS, however, the fragment ions need to be scanned out and therefore is slower than QitTof MS.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A detector system, comprising:

an ionizer;

an ion trap coupled to said ionizer;

a detector coupled to said ion trap; and, controller means for generating a voltage waveform to isolate at least one ion within said ion trap, and generating a modulated voltage potential to dissociate the isolated ion and create a dissociated ion within said ion trap, said dissociated ion is then detected by said detector, said controller means generates a broadband voltage potential with a plurality of frequency notches to isolate a plurality of ions and provides a plurality of secular frequencies to said ion trap to dissociate the ions.

2. The system of claim 1, wherein a plurality of dissociated ions are generated, said controller simultaneously pulses all of said dissociated ions out of said trap and into said detector.

3. The system of claim 1, wherein said modulated voltage potential has a frequency.

4. The system of claim 1, wherein said controller contains a memory that stores various modulated voltage potential amplitudes.

5. The system of claim 1, wherein said ion trap is anharmonic and said controller generates a frequency sweep to eject the dissociated ion into said detector.

6. The system of claim 1, wherein said ion trap is a quadrupole ion trap that contains an end cap electrode and a ring electrode, said controller provides said modulated voltage potential to said ring electrode to dissociate the ion.

7. The system of claim 3, wherein said modulated voltage potential contains a plurality of frequencies.

8. The system of claim 3, wherein said modulated voltage potential is amplitude modulated.

9. The system of claim 3, wherein said modulated voltage potential is frequency modulated.

10. The system of claim 3, wherein said frequency is varied by varying a clock of said controller.

11. A method for detecting a trace molecule in a sample, comprising:

isolating an ion within an ion trap with a broadband voltage potential that has a plurality of frequency notches;

determining a modulated voltage potential to be applied to the ion trap;

applying the voltage potential to dissociate the ion with a plurality of secular frequencies;

ejecting the dissociated ion from the ion trap; and, detecting a mass of the dissociated ion.

12. The method of claim 11, wherein the modulated voltage potential is stored in a memory.

13. The method of claim 11, further comprising isolating a second ion and dissociating the second ion with a voltage potential having a different amplitude.

14. The method of claim 11, wherein the modulated voltage potential has a frequency.

15. The method of claim 14, wherein the modulated voltage potential contains a plurality of frequencies.

16. The method of claim 14, wherein the voltage potential is amplitude modulated.

17. The method of claim 14, wherein the modulated voltage potential is frequency modulated.

18. The method of claim 14, wherein the frequency is varied by varying a clock used to generate the modulated voltage potential.

19. A detector system, comprising:

an ionizer;

an ion trap coupled to said ionizer;

a detector coupled to said ion trap; and, controller means for generating a voltage waveform to isolate at least one first ion in said ion trap, generating a first voltage to dissociate the isolated first ion to create a first dissociated ion, isolating the first dissociated ion without isolating the first ion, generating a second voltage to further dissociate the first dissociated ion to create a second dissociated ion that is then detected by said detector.

20. The system of claim 19, wherein said controller pulses said first and second dissociated ions out of said trap and into said detector.

21. The system of claim 19, wherein said varying waveform is amplitude modulated.

22. The system of claim 19, wherein said varying voltage waveform is frequency modulated.

23. The system of claim 19, wherein said voltage waveform is varied by varying a clock of said controller.

24. A method for detecting a trace molecule in a sample, comprising:

isolating a first ion within an ion trap;

applying a first voltage to dissociate the first ion to create a first dissociated ion;

isolating the first dissociated ion without isolating the first ion;

applying a second voltage to further dissociate the dissociated first ion to create a second dissociated ion;

ejecting the second dissociated ion from the ion trap; and, detecting a mass of the second dissociated ion.

25. The method of claim 24, wherein the voltage is amplitude modulated.

26. The method of claim 24, wherein the voltage is frequency modulated.

* * * * *